United States Patent [19]

Haynes et al.

[11] Patent Number: 4,610,932

[45] Date of Patent: Sep. 9, 1986

[54] ELECTRICAL CONTACTS

[75] Inventors: Richard Haynes, East Windsor; Hung C. Ling, West Windsor Township, Mercer County; Sau-Lan L. Ng, Lawrence Township, Mercer County, all of N.J.

[73] Assignee: AT&T Technologies, Inc., Berkeley Heights, N.J.

[21] Appl. No.: 678,892

[22] Filed: Dec. 6, 1984

[51] Int. Cl.[4] ..... G22F 1/10

[52] U.S. Cl. ..... 428/611; 428/671; 428/680; 428/929

[58] Field of Search ..... 428/611, 671, 675, 680, 428/929

[56] References Cited

U.S. PATENT DOCUMENTS 3,232,718 1/1966 Senk, Jr. et al. ..... 428/611

4,499,155 2/1985 Holiden ..... 428/586

4,503,131 3/1985 Baudrand ..... 428/672

FOREIGN PATENT DOCUMENTS 8300945 3/1983 PCT Int'l Appl. ..... 339/278 C

OTHER PUBLICATIONS

"Effect of Crystal Structure on the Anodic Oxidation of Nickel" by J. L. Weininger and M. W. Breiter, *Journal of the Electrochemical Society,* 110, (6), pp. 484 et seq., 1963.

*Primary Examiner*—Christopher W. Brody

*Attorney, Agent, or Firm*—J. F. Spivak

[57] ABSTRACT

An electrical contact comprises a base metal and an electroplated nickel layer thereover wherein said nickel layer is preferentially oriented in a <111> crystallographic plane along the surface of the nickel.

6 Claims, 3 Drawing Figures

ELECTRICAL CONTACTS

TECHNICAL FIELD

This invention relates to electrical contacts and in particular, electrical contacts comprising a base metal having an electroplated nickel or nickel alloy surface layer thereover.

BACKGROUND OF THE INVENTION

Generally, for a material to be suitable for use as an electrical contact, it should be non-fusing with a mating contact material and have a low, ohmic, contact resistance with a relatively small contact pressure. In addition, the material must be capable of maintaining the low resistance after a large number of operations over an extended life period and be corrosion resistant.

Among the contact materials employed in the past are the precious metals such as gold, palladium and platinum and alloys of such metals with each other as well as with metals such as silver and nickel. Due to the high cost of precious metals, a large effort has been employed to find contact materials which are substantially cheaper than the precious metals but which also possess all or many of the properties of the precious metals as mentioned above and, for certain applications, are also solderable.

Marcus et al., in U.S. Pat. No. 4,361,718, have reported the use of nickel-antimony alloy as a contact material over the n-type region of a silicon solar cell. The particular alloy is a 50-50 mixture of nickel and antimony so as to give the compound nickel antimonide and is applied as a powder in the form of a thick film over the solar cell.

We have now discovered that nickel having a surface orientation in a specific crystallographic plane has a much lower contact resistance than ordinary nickel after aging. We have further discovered that such preferred orientation can be induced by doping the nickel with small amounts of specific impurities during electroplating of the nickel.

SUMMARY OF THE INVENTION

An electrical contact comprises a base metal and an electroplated nickel layer thereover wherein said nickel layer is preferentially oriented in a <111> crystallographic plane along the surface of the nickel.

DETAILED DESCRIPTION

We have discovered that the contact resistance of nickel which is preferentially oriented in the <111> crystallographic plane along the surface of the contact has a significantly lower contact resistance after aging as compared with ordinary electroplated nickel or nickel which one achieves by other deposition techniques. Generally, electroplated nickel or nickel deposited by other means does not take on a <111> preferred orientation. We have further discovered that by doping the nickel with small amounts of Sb, Zn, P, In, Cd, Co or As one can induce the deposited metal to form in the preferred <111> orientation as opposed to other crystallographic orientations. It appears that Sb, P, Zn and In are the preferred dopants for obtaining the preferred orientation.

The contact resistances of electrodeposited nickel doped with various dopants on a copper base metal have been studied. After an accelerated aging test at 35° C. and 95 percent relative humidity for seven days, it was found that nickel which deposits with a <111> preferred orientation has lower contact resistance than those deposits having other preferred orientations, e.g., the <200> orientation. It is speculated that the addition of certain foreign elements in the nickel bath lowers the overvoltage of the deposition of nickel, causing the change from the usual nickel deposit to the <111> preferred orientation.

Generally, electroplated nickel deposits from solutions containing nickel sulfate and nickel chloride have preferred orientations in the <100> and <110> crystallographic planes, respectively, rather than the <111> orientation. It has been found that the contact resistance of pure nickel having a preferred orientation of <100> is 4 to 5 times higher than that of nickel having a preferred orientation of <110> after aging. Similarly, the contact resistance of the <110> preferred orientated nickel, after aging, is significantly higher than that of the nickel having a <111> preferred orientation.

Figure 1:
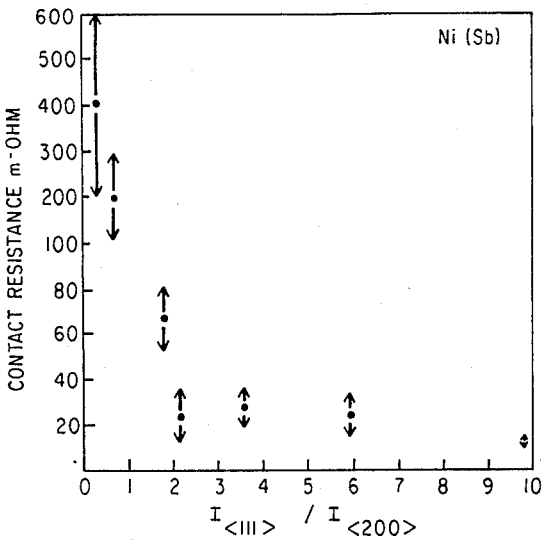
FIGS. 1, 2 and 3 are graphical representations of contact resistance in milliohms versus the ratio of the relative crystallographic X-ray intensities of nickel in the <111> plane to nickel in the <200> plane for nickel doped with Sb, In and P, respectively.
Figure 2:
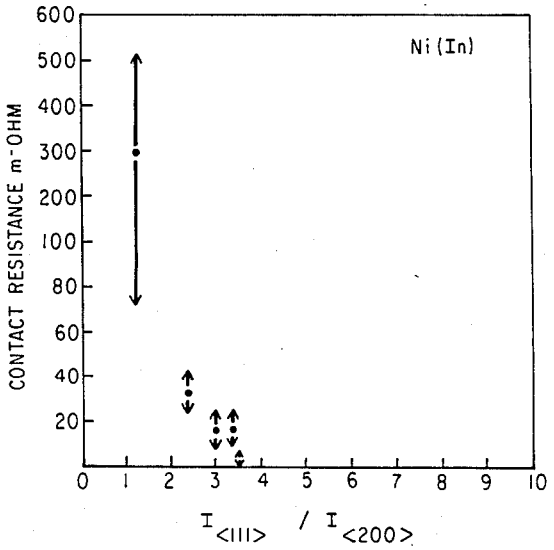
Figure 3:
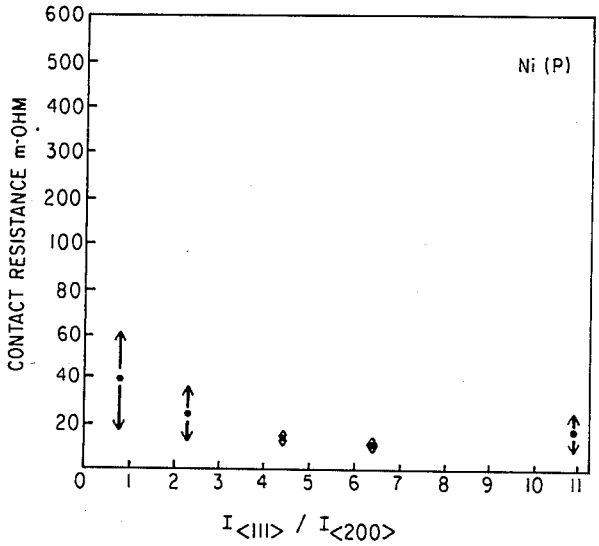

FIGS. 1-3 illustrate the ratio of the <111> to °200> X-ray peak intensities as a function of the contact resistance after aging for Sb, P and In doped nickel For each of the materials studied, high contact resistance is observed for low values of $I_{111}/I_{200}$ and the contact resistance drops dramatically when $I_{111}/I_{200}$ increases. Thus, doped nickel with <111> preferred orientation has lower contact resistance after aging. Conversely, doped nickel with <200> preferred orientation has significantly higher contact resistance. We have also found that contact resistances tend to increase in the order <111>, <220> and <200>.

Generally, doped nickel electrical contacts were prepared by electrolytically plating Ni on a copper or copper alloy base metal. The plating solution was composed of a nickel salt, e.g., nickel sulfate or nickel chloride, together with a small amount of dopants in the form of a dissolved salt of, for example, antimony, zinc, phosphorus or indium. The plating solution was maintained at a pH of 2.5 by adding tartaric acid or boric acid. The temperature of the bath was generally maintained at 80° C. or above. Platinum was used as the anode. A known constant current was passed through the cells of the power supply. Pure nickel deposited from a solution containing nickel sulfate or nickel chloride at pH 2.5 was used as a reference. The composition of the electrodeposited coatings was determined by alpha-Cu radiation energy dispersive spectroscopy and the structure was determined by X-ray diffraction. Static contact resistance measurements were made utilizing a gold wire probe with an applied load of 50 gm. The test was carried out with a dc current of 10 ma and an open circuit voltage of 27 mv. The contact resistance measurements were made both before and after aging. Aging was carried out in a humidifier chamber at 35° C. and 95 percent relative humidity for seven days. It may be noted that the electrodeposited nickel obtained from a nickel sulfate solution was bright and hard as compared with a dark and soft nickel deposit obtained from a nickel chloride solution. It may also be noted that nickel phosphide was deposited at a pH of 1.0. We have discovered that by the addition of foreign elements to the nickel plating bath, e.g., in concentrations of from 0.2 to 20 mM of a salt of zinc, antimony, phosphorus or indium (depending upon the salt), preferred orientation of nickel deposits change from <100> to <111>. It has also been found that the applied current density plays a role in the preferred orientation obtained on the electrodeposited doped nickel Generally, low current densities lead to the preferred <111> crystallographic orientation. Table I below gives typical dopant concentrations and operating conditions while table II summarizes the effect of current density on the crystallographic orientation of doped nickel.

TABLE I

| REAGENTS | CONCEN-TRATION | CURRENT DENSITY | TEMP. |
|---|---|---|---|
| *$ZnSO_4.7H_2O$ | 0.3~20 mM | 2~50 ma/cm$^2$ | 85~90° C.* |
| $K(SbO)C_4H_4O_7$ | 1.0~20 mM | 10~200 | 85~90° C. |
| *$H_3PO_3$ | 1.0~12 mM | 10~100 | 85~90° C. |
| *$InSO_4$ | 0.2~1.0 mM | 30~50 | 85~90° C. |

*with stirring

TABLE II

EFFECT OF CURRENT DENSITY ON THE TEXTURE OF DOPED NICKEL

| DOPED NICKEL | CURRENT DENSITY | PREFERRED ORIENTATION |
|---|---|---|
| Ni(P) | 100 | 111 |
| | 500 | 100 |
| Ni(Zn) | 100 | 111 & 110 |
| | 400 | 100 |
| Ni(Sb) | 30 | 111 |
| | 100 | 100 |
| Ni(In) | 30 | 111 |
| | 300 | 110 |

What is claimed is:

1. An electrical contact comprising a base metal and a nickel layer thereover said nickel layer having an exposed surface which is preferentially oriented in the 111 crystallographic plane and wherein said nickel includes an additive selected from the group consisting of Sb, In, P and Zn in an amount so as to have caused the preferential orientation in the 111 plane.

2. The contact recited in claim 1, wherein the nickel is electrodeposited.

3. The contact recited in claim 2, wherein the electrodeposition is from a nickel sulfate bath at low current density.

4. The contact recited in claim 1, wherein the base metal is selected from copper and a copper alloy.

5. The contact recited in claim 3, wherein said nickel sulfate solution further contains a salt of at least one member of the group consisting of Sb, In, P and Zn.

6. The contact recited in claim 5, wherein the salt is present in a concentration of from 0.2 to 20 mM.

* * * * *